US010669077B2

(12) United States Patent
Luzzato et al.

(10) Patent No.: US 10,669,077 B2
(45) Date of Patent: Jun. 2, 2020

(54) CAP FOR CLOSING THE SPOUT OF A CONTAINER

(71) Applicant: Novembal USA Inc., Edison, NJ (US)

(72) Inventors: Michel Luzzato, Ecully (FR); Stéphane Graux, Liergues (FR)

(73) Assignee: Novembal USA Inc., Edison, NJ (US)

( * ) Notice: Subject to any disclaimer, the term of this patent is extended or adjusted under 35 U.S.C. 154(b) by 1171 days.

(21) Appl. No.: 14/358,270

(22) PCT Filed: Nov. 14, 2012

(86) PCT No.: PCT/EP2012/072606
§ 371 (c)(1),
(2) Date: May 15, 2014

(87) PCT Pub. No.: WO2013/072361
PCT Pub. Date: May 23, 2013

(65) Prior Publication Data

US 2014/0291323 A1 Oct. 2, 2014

(30) Foreign Application Priority Data

Nov. 18, 2011 (FR) ..... 11 60544

(51) Int. Cl.
*B65D 41/48* (2006.01)
*B65D 47/36* (2006.01)

(52) U.S. Cl.
CPC ..... *B65D 41/48* (2013.01); *B65D 41/485* (2013.01); *B65D 47/36* (2013.01)

(58) Field of Classification Search
CPC .... B65D 2101/0053; B65D 2101/0023; B65D 41/3485; B65D 2101/0038;
(Continued)

(56) References Cited

U.S. PATENT DOCUMENTS 3,434,613 A 3/1969 Langecker
3,840,137 A * 10/1974 Faulstich ..... B65D 41/48 215/256
(Continued)

FOREIGN PATENT DOCUMENTS

FR 1378912 11/1964

OTHER PUBLICATIONS

International Search Report in PCT/EP2012/072606, dated Dec. 12, 2012 (2 pages).

*Primary Examiner* — Anthony D Stashick
*Assistant Examiner* — Blaine G Neway

(57) ABSTRACT

A cap for closing a neck of a bottle is disclosed. The cap includes a lid for closing off the neck and a skirt for fixing to the neck. The skirt is provided with a bulge line for interfering by wedging with the neck, a weakened line to be ruptured by propagation of a tear, and a stop means for preventing the tearing propagating in the rectilinear extension of a first part of the weakened line that runs along the bulge line while being situated on the side of the latter opposite to the lid. The weakened line also includes second and third substantially rectilinear parts which, on the periphery of a skirt, follow on respectively from the first part to the second part of the weakened line. The second part of the weakened line avoids the stop means and extends on either side of the bulge line, while being inclined both with respect to the bulge line and with respect to the direction of the axis of the skirt. The third part of the weakened line extends along the bulge line while being situated on the side of the bulge line turned towards the lid.

14 Claims, 5 Drawing Sheets

(58) Field of Classification Search
CPC ..... B65D 2101/0046; B65D 41/48; B65D 41/485; B65D 47/36
USPC ..... 220/266; 215/256, 254, 253
See application file for complete search history.

(56) References Cited

U.S. PATENT DOCUMENTS

| | | | | |
|---|---|---|---|---|
| 4,162,736 | A * | 7/1979 | Faulstich | B65D 41/485 215/256 |
| 4,416,383 | A * | 11/1983 | Frahm | B65D 41/48 215/256 |
| 4,911,316 | A * | 3/1990 | Tackles | B65D 41/48 215/256 |
| 6,619,498 | B2 * | 9/2003 | von Holdt, Jr. | B65D 21/0219 220/276 |
| 7,581,653 | B2 | 9/2009 | Perrin et al. | |
| 2005/0218106 | A1 * | 10/2005 | Yui | B65D 41/50 215/256 |
| 2007/0023383 | A1 * | 2/2007 | Perrin | B65D 41/48 215/255 |

* cited by examiner

CAP FOR CLOSING THE SPOUT OF A CONTAINER

CROSS-REFERENCE TO RELATED APPLICATIONS

This is a U.S. National Phase of PCT/EP2012/072606, filed Nov. 14, 2012, which claims the benefit of priority to French Patent Application No. 1160544, filed Nov. 18, 2011, which is incorporated herein by reference.

TECHNICAL FIELD

The present invention concerns a cap for closing the neck of a container.

BACKGROUND

The invention concerns in particular the case of containers consisting of a bottle for liquid, able to contain at least around ten litres of liquid, in particular water, typically bottles for water of three, four or five gallons, which are used in an inverted position in dispensing fountains. The neck of these bottles is closed by a cap generally referred to as "snapped on", that is to say a cap the tubular skirt of which is able to be clipped internally or, more generally, wedged coaxially around the neck, unlike screwed caps for example. The majority of bottles of this type can be reused many times, having their cap removed and then cleaned before each filling.

In order to remove the cap easily vis-à-vis the neck, providing a weakened line on the skirt is known, which runs on at least a portion of the periphery of the skirt and along which a tear on the wall of the skirt propagates, initiated manually by the user. In the context of the bottles mentioned above, this weakened line generally includes a main part that is rectilinear and extends on the axial side, turned towards the free end of the skirt, internal reliefs on the skirt enabling it to be wedged on the neck in order to hold the cap around the neck: in this way, when this main part of the weakened line is broken, the whole part of the skirt situated between this main part of the weakened line and the free end of the skirt forms a strip that it is practical for the user to handle in order to pull, in the direction of the axis, on the remainder of the cap and thus forcibly release the latter vis-à-vis the neck. This being said, some users have a tendency to use the aforementioned strip to propagate the tearing of the skirt all around the neck, which they moreover mange to do easily, so that the lid of the cap and the skirt part remaining connected to this lid remain in place through the opening of the neck: the user must then grip this lid and/or this residual skirt part, in order to extract them from the neck. This handling in two stages is restrictive and sometimes proves to be difficult, or even almost impossible to perform with regard to the extraction of the remainder of the cap because of the strong interference between the neck and the internal reliefs on the skirt, necessarily present in the part of the skirt left in place after the aforementioned strip is pulled away.

These problems are partly dealt with by U.S. Pat. No. 7,581,653, on which is based the preamble of appended claim 1 and which proposes firstly to prevent the tearing of the skirt being propagated beyond what is necessary, by means of a stop for this tear, arranged projecting inside the skirt, in rectilinear extension of the main part of the weakened line, and, secondly, to extend the weakened line with a short segment that is parallel to the central axis of the skirt and is situated at the same axial level as the internal reliefs wedging the skirt around the neck.

This being so, the aim of the present invention is to improve existing caps by proposing arrangements that are both economical and further facilitate the release of the cap vis-à-vis the neck.

BRIEF SUMMARY

To this end, the subject matter of the invention is a cap for closing the neck of a container, as defined in claim 1.

One of the ideas at the basis of the invention is, when the skirt is torn, to seek to "neutralise" part of the fixing effect produced by the bulge line, so as to significantly reduce the forces for releasing the cap, in particular to extract a remainder of the cap in the case where the user has completely pulled away the major part of the skirt, namely the bottom part of the skirt when it is considered that the central axis of the skirt is vertical and its lid is turned upwards. To this end, the invention makes provision for extending the first part of the weakened line, which runs in a substantially rectilinear fashion along and below the bulge line, by successively a second weakened line part that is inclined aslant with respect to the first part and moving away therefrom upwards, and a third weakened line part that runs in a substantially rectilinear fashion along and above the bulge line. In this way, the tearing of the skirt along its weakened line during the breaking of the latter is guided successively along the bottom side of the bulge line, and then through this bulge line, and this progressively in order to assist the upward guidance of the break, and then along the top side of the bulge line: thus the bottom part of the skirt, which is separated from the rest of the cap because of the rupture of the weakened line and forms a practical strip to be gripped by the user, carries internally at least a portion of the bulge line, namely the one on which the third part of the weakened line extends, as well as, where applicable, the one on which the tearing is forcibly propagated by the user from the end of this third part, opposite to the second part of the weakened line. As a result the aforementioned portion of the bulge line no longer participates in the fixing of the cap around the neck, and this fixing can then very easily be overcome in order to release the cap vis-à-vis the neck, including in the case where resistance to this release persists in relation to the presence of an internal sealing lip with which the lid is provided and which bears against the internal face of the neck.

Additional advantageous features of the cap according to the invention are specified in dependent claims 2 to 14.

BRIEF DESCRIPTION OF THE DRAWINGS

The invention will be understood better from a reading of the following description, given solely by way of example and made with reference to the drawings, in which.

DETAILED DESCRIPTION

Figure 1:
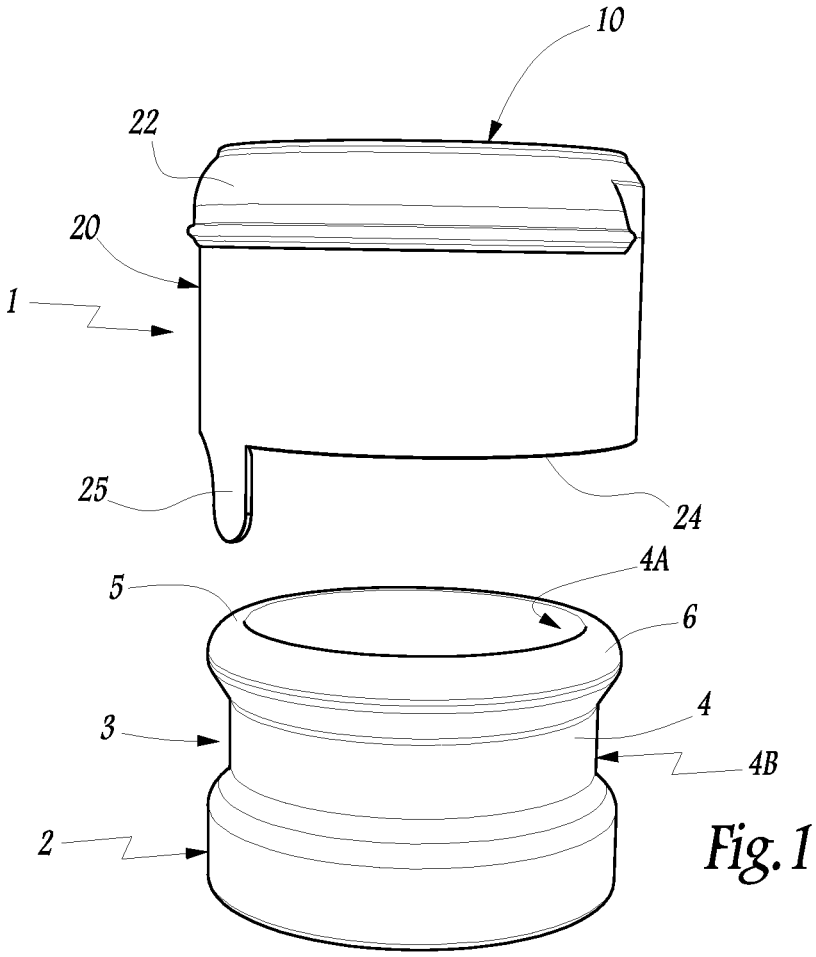
FIG. 1 is an exploded perspective view of a cap according to the invention and a neck of a container able to be closed by the cap.

FIGS. 1 to 10 show a cap able to close the neck 3 of a container 2.

In general terms, the neck 3 is either made in one piece with the rest of the container 2, in particular when the latter is a receptacle made from glass or plastics material, or able to be permanently secured to a wall of the container 2, at an opening passing through this wall. As disclosed in the introductory part of the present document, the container 2 is preferentially a bottle containing at least around ten litres of liquid, in particular a water bottle having a capacity of three, four or five gallons.

The neck 3 has a substantially tubular shape the central longitudinal axis of which is referenced X-X. For convenience, the remainder of the description of the cap 1 is oriented with respect to the axis X-X, the terms "bottom" and "low" referring to a part of the cap that is directed axially towards the main body of the container 2 when the cap 1 closes off the neck 3 of this container and the latter is resting on a horizontal plane, such as a table, with its neck 3 directed upwards, as in FIGS. 1, 2 and 6 to 9. Conversely, the terms "upper" and "top" correspond to an axial orientation in the opposite direction. Likewise, the term "internal" refers to a part of the cap 1 that is directed transversely towards the axis X-X while the term "external" corresponds to a transverse orientation in the opposite direction.

The cap 3 has a substantially tubular body 4, with a circular base centred on the axis X-X. The top axial end 5 of the body 4 is free, being open on the outside, while, at its opposite axial end, the body 4 emerges in the main body, not shown, of the container 2. The free end 5 of body 4 connects the internal 4A and external 4B faces of this body to each other. The external face 4B of the body 4 is provided with a heel 6 projecting outwards.

Figure 2:
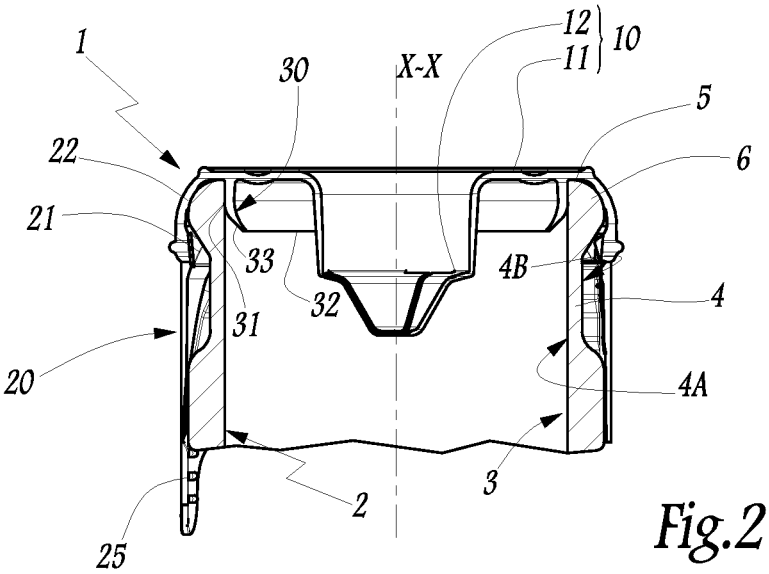
FIG. 2 is a longitudinal section of the cap of FIG. 1, in the configuration of closure of the cap.

As can be seen clearly in FIGS. 1 to 4, the cap 1 has a substantially tubular shape the central longitudinal axis of which is merged with the axis X-X of the neck 3 when the cap 1 is fitted on the neck. The cap 1 is open at its bottom end and closed at its top end by a lid 10 which, when the cap 1 is in the closure configuration on the neck 3, as in FIG. 2, is arranged across the internal opening of the neck so as to close off the latter. The external peripheral part 11 of the lid 10 is substantially flat. The internal peripheral part 12 of the lid 10 has for its part a stepped tubular shape centred on the axis X-X that is typically intended to cooperate with a supply head of a water fountain and will not be described any further since this aspect of the cap 1 is not limitative of the invention.

A substantially tubular skirt 20, centred on the axis X-X and with a circular base, extends downwards at the external periphery of the lid 10, being made in one piece with the peripheral part 11 of the lid.

The internal face 20A of the skirt 20 is provided with a bulge line 21 that projects inwards and runs over the entire periphery of the skirt. This bulge line 21 is designed to cooperate by diametral interference with the external heel 6 of the neck 3 for the purpose of fixing the skirt 20 by wedging coaxially around the neck when the cap 1 is in closed configuration on this neck, as shown in FIG. 2.

In the embodiment considered in the figures, the bulge line 21 is situated at a substantially constant axial level of the skirt 20 and runs on the internal periphery of the skirt while being regularly interrupted, which amounts to stating that this bulge line 21 consists of a succession of bulging portions, distributed along the periphery of the internal face 20A of the skirt 20. In a manner known per se, this arrangement aims, among other things, to increase the transverse flexibility of the skirt 20 at the axial level of the bulge line 21. Naturally, by way of a variant that is not shown, the bulge line can be provided so as to be continuous over the entire internal periphery of the skirt.

The external face 20B of the skirt 20 is for its part provided with a peripheral band 22 projecting outwards. This band 22 is situated, in the direction of the axis X-X, substantially at the same level as the bulge line 21, as clearly visible in FIGS. 6 and 7. The presence of this projecting external band 22 has several advantages, alternative or cumulative. This is because this band 22 stiffens the longitudinal part of the skirt 20, around which the band 22 is situated, which reinforces the fixing of the skirt around the neck 3, in the sense that, after the cap 1 is fitted on the neck 3, the band 22 makes the bulge line 21 more resistant to outward radial deformation. In this light, it will be noted that the maximum projecting dimension of the band 22 is advantageously situated at the same axial level as the bulge line 21. Another advantage of the band 22 relates to the fact that the projecting relief that it forms on the external surface 20B of the skirt 20 can be engaged by tools manipulating the cap 1, both during operations aimed at fitting the cap on the neck 1 in order to close the latter and during operations aimed at forcibly releasing this cap vis-à-vis the neck without having recourse to the arrangements, described a little further on, of the skirt 20 enabling a user to tear it at least partially by hand. Whatever may be the technical effect or effects relating to the presence of the band 22, it will be noted that this band 22 does not run over the entire external periphery of the skirt 20 but on the contrary this band 22 is interrupted over a predetermined portion of the skirt, as clearly visible in FIGS. 4 and 5. The advantage of this peripheral interruption of the band 22 will appear below.

The skirt 20 is moreover provided with a weakened line 23 which, as explained in detail below, runs on only part of the periphery of this skirt. This weakened line 23 is designed so as, under the action of the user, to be ruptured so as to separate from each other the parts of the skirt 20 that initially were connected to each other by the weakened line 23. In relation to the considerations developed in the introductory part of the present document, it will be understood that the weakened line 23 is ruptured by a user when the latter wishes to completely release the cap 1 vis-à-vis the neck 3 of the container 2, in particular for purposes of reuse of this container.

The weakened line 23 includes or even, as in the example considered in the figures, consists of four parts, which are respectively referenced 23.0, 23.1, 23.2 and 23.3 and which succeed one another along the periphery of the skirt 20, while being respectively associated with portions 20.0, 20.1, 20.2 and 20.3 of the skirt on which the corresponding parts of the weakened line extend from one peripheral end to the other. The weakened line parts 23.0 to 23.3 are clearly visible in FIG. 10, which shows a linear projection of the skirt 20, beginning, on the left in FIG. 10, with the portion 20.0 and continuing to the right of FIG. 10 with successively the skirt portions 20.1, 20.2 and 20.3. In addition, also as clearly visible in this FIG. 10, as well as in FIG. 5, the portion of the skirt 20, connecting the skirt portion 20.3 to the skirt portion 20.0, moving away from the skirt portion 20.2, is referenced 20.4: in other words, the entire skirt 20 is divided into the four skirt portions 20.0 to 20.4, the skirt portion 20.0 to 20.3 having the parts 23.0 to 23.3 of the weakened line 23 pass over them, while the skirt portion 20.4 does not have the weakened line pass over it.

Figure 5:
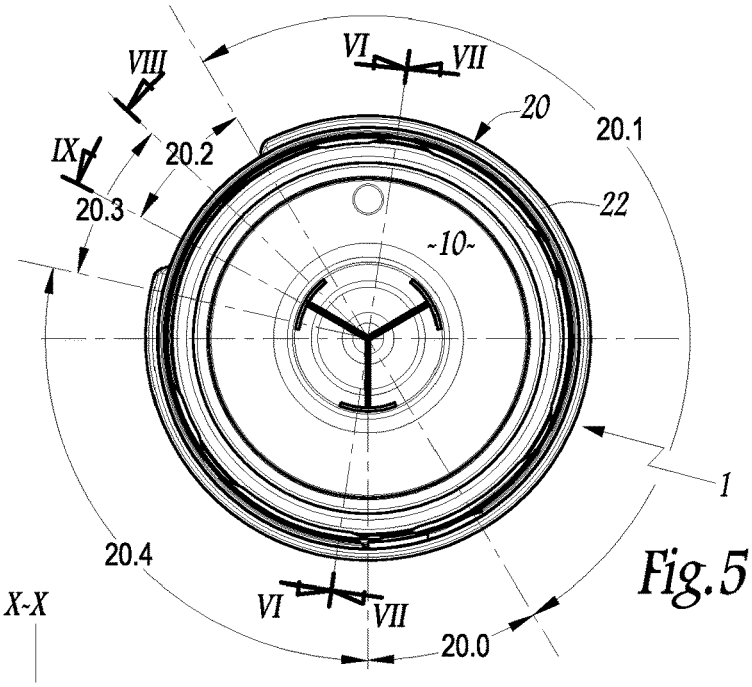
FIG. 5 is an elevation view along the arrow V in FIG. 4.

As clearly visible in FIG. 5, the skirt portions 20.2 and 20.3 form conjointly the portion of the skirt 20 in which the band 22 is continuously interrupted, as mentioned above. The advantage of this arrangement will appear below.

Figure 10:
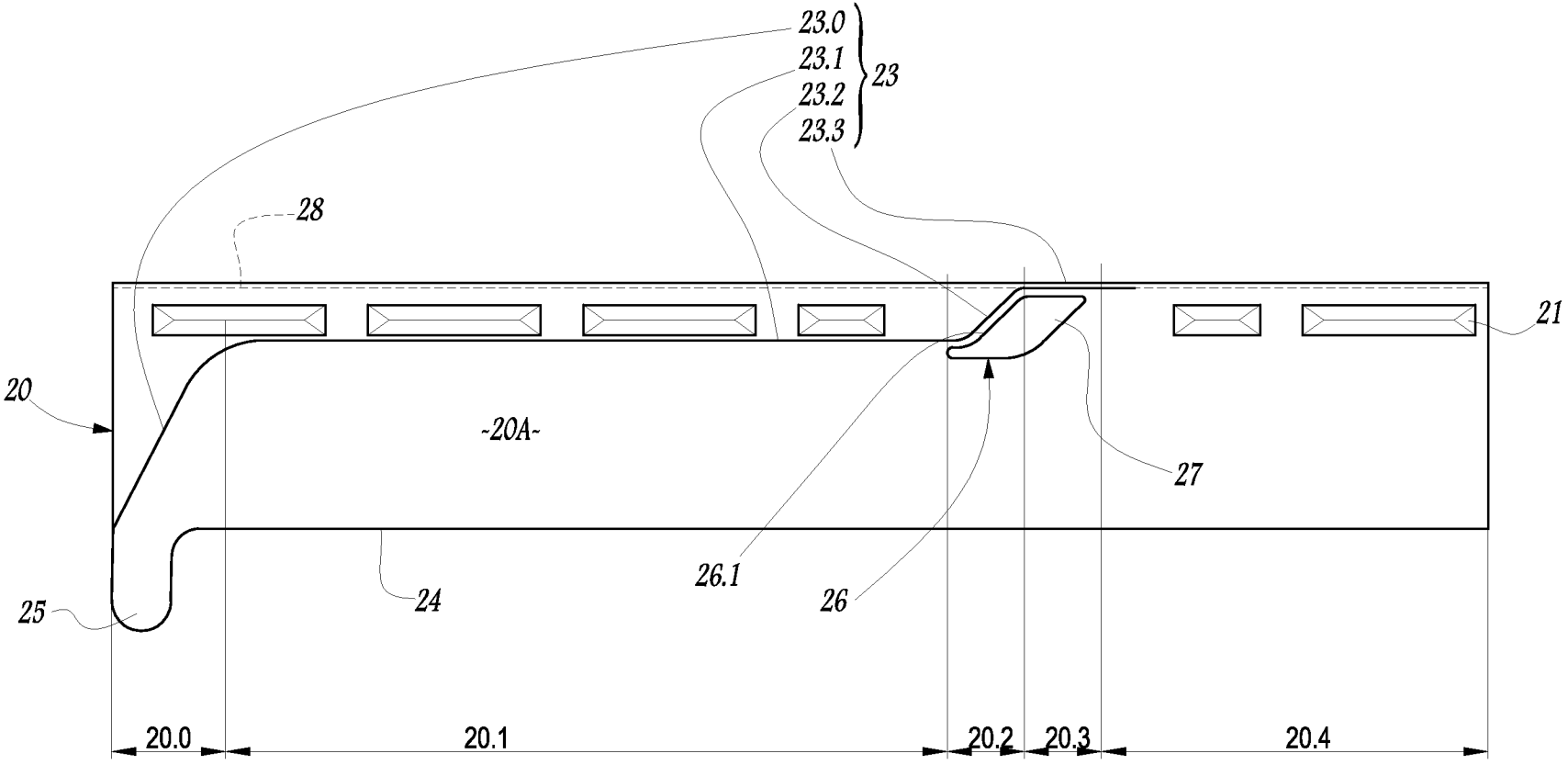
FIG. 10 is a view in elevation of a linear projection of part of the cap.

The weakened line parts 23.0 to 23.3 are substantial rectilinear, in the sense that each of them connects to each other their peripheral ends by the shortest path along the periphery of the skirt 20: as a result, in the linear projection in FIG. 10, each of these weakened lines parts corresponds substantially to a straight-line segment.

Advantageously, for reasons that will emerge below, the areas connecting the adjacent weakened line parts in pairs are not angular but on the contrary are curved, as clearly visible in FIGS. 3, 4 and 10.

The part 23.1 of the weakened line 23 is, in the direction of the axis X-X, situated close to the bulge line 21, while being situated below this bulge line. In other words, this weakened line part 23.1 runs along the bottom axial side of the bulge line 21, and this, in the example embodiment considered in the figures, in a direction orthoradial to the axis X-X.

Figure 4:
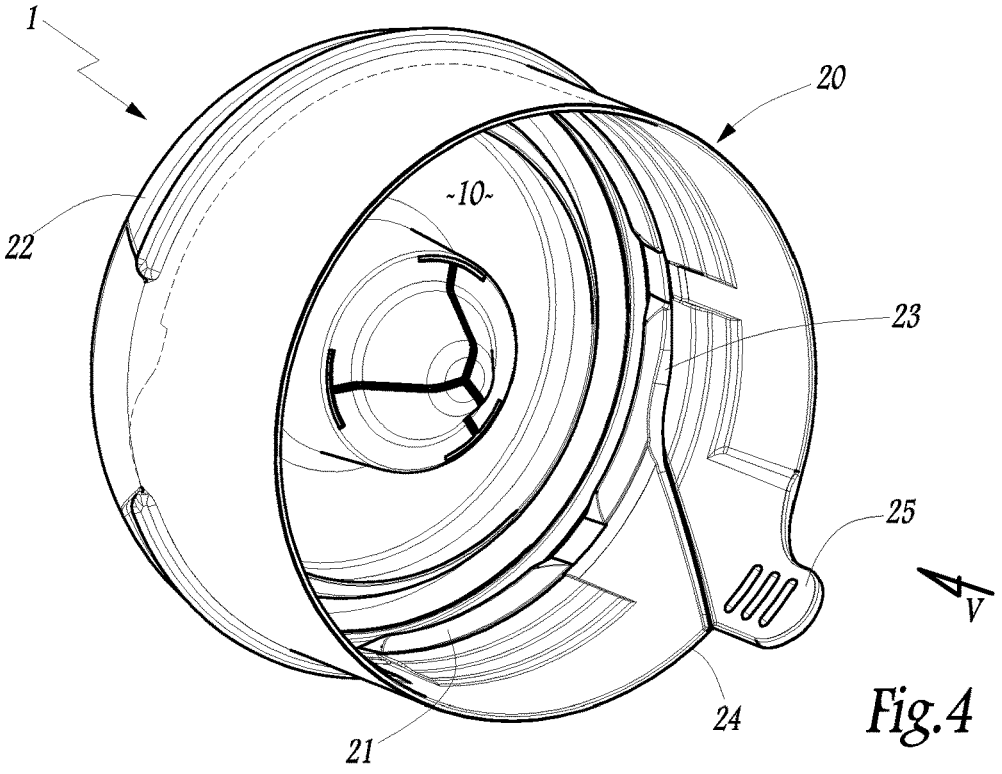
Figure 6:
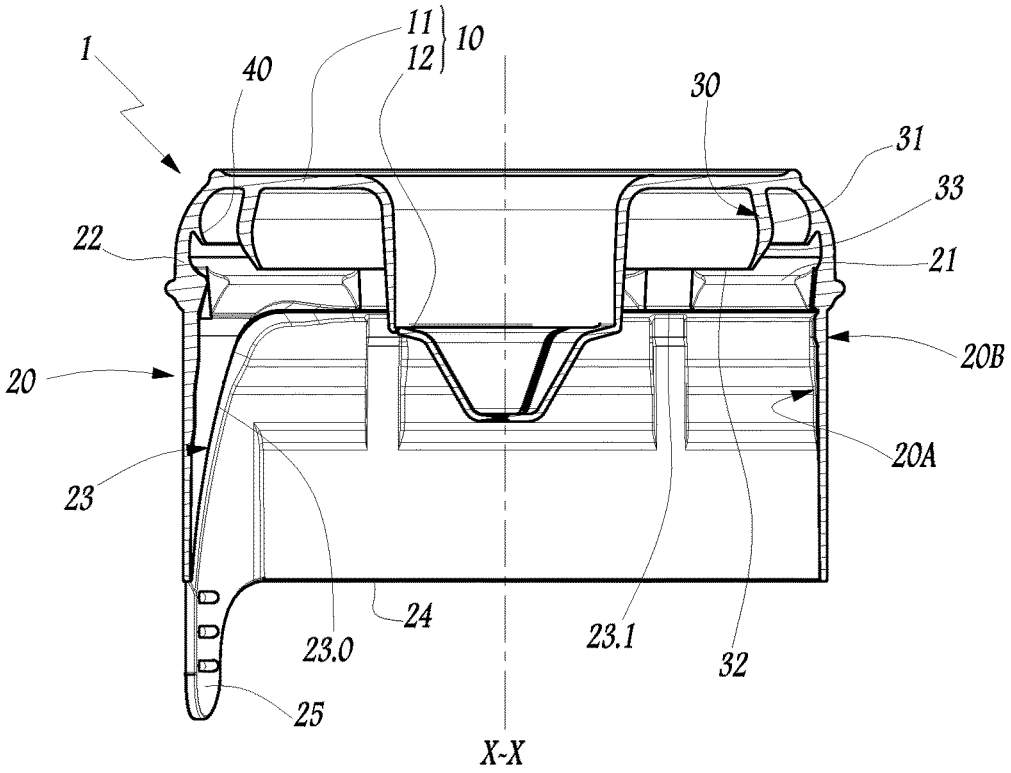
FIGS. 6 and 7 are longitudinal sections respectively along the lines VI-VI and VII-VII in FIG. 5, it being noted that the common cutting plane of these FIGS. 6 and 7 corresponds substantially to the cutting plane in FIG. 2.

The part 23.0 of the weakened line 23 connects the weakened line part 23.1 to the bottom free end 24 of the skirt 20, as clearly visible in FIGS. 4, 6 and 10. Advantageously, the skirt portion 20.0 is provided with a tongue 25 projecting downwards from the bottom free end of the rest of the skirt 20, in the immediate vicinity of the weakened line part 23.0 on the periphery of the skirt portion 20.0: in a manner known per se, this tongue 25 is designed to be gripped by the fingers of a user in order to be separated from the neck 3 of the container 2, which causes an initiation of a tear at the free end of the weakened line part 23.0.

The part 23.3 of the weakened line 23 for its part is situated axially above the bulge line 21, running along this bulge line 21 on the skirt portion 20.3, and this, in the example embodiment considered here, in a direction orthoradial to the axis X-X.

Figure 3:
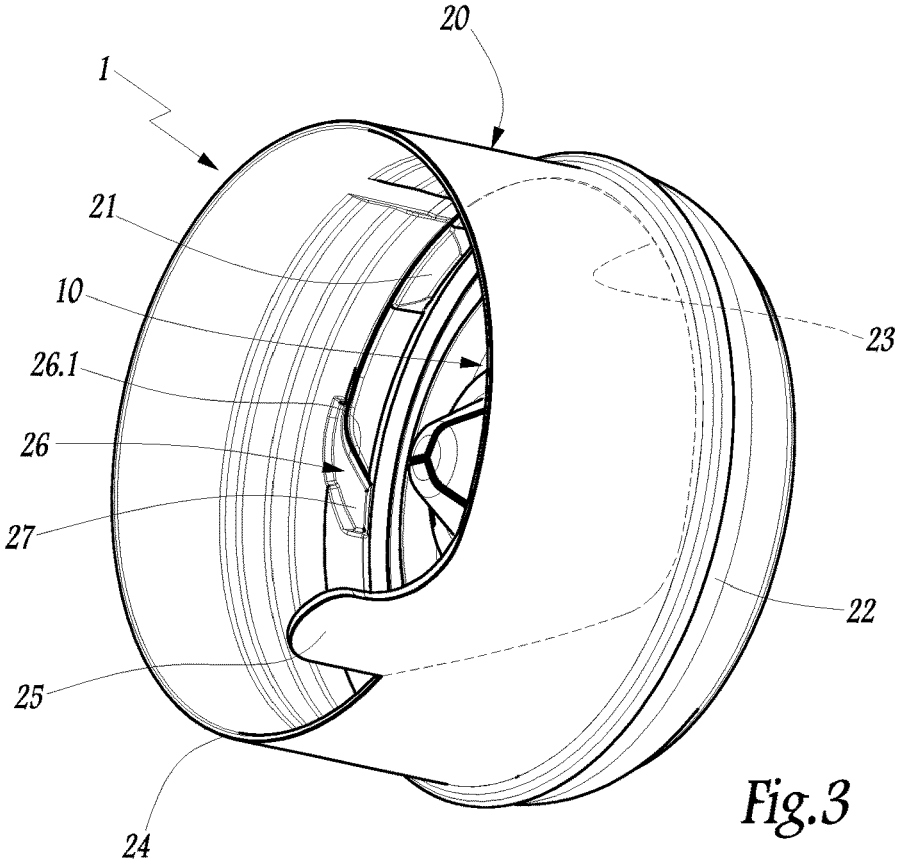
FIGS. 3 and 4 are perspective views, at different observation angles, of the cap in FIG. 1.
Figure 7:
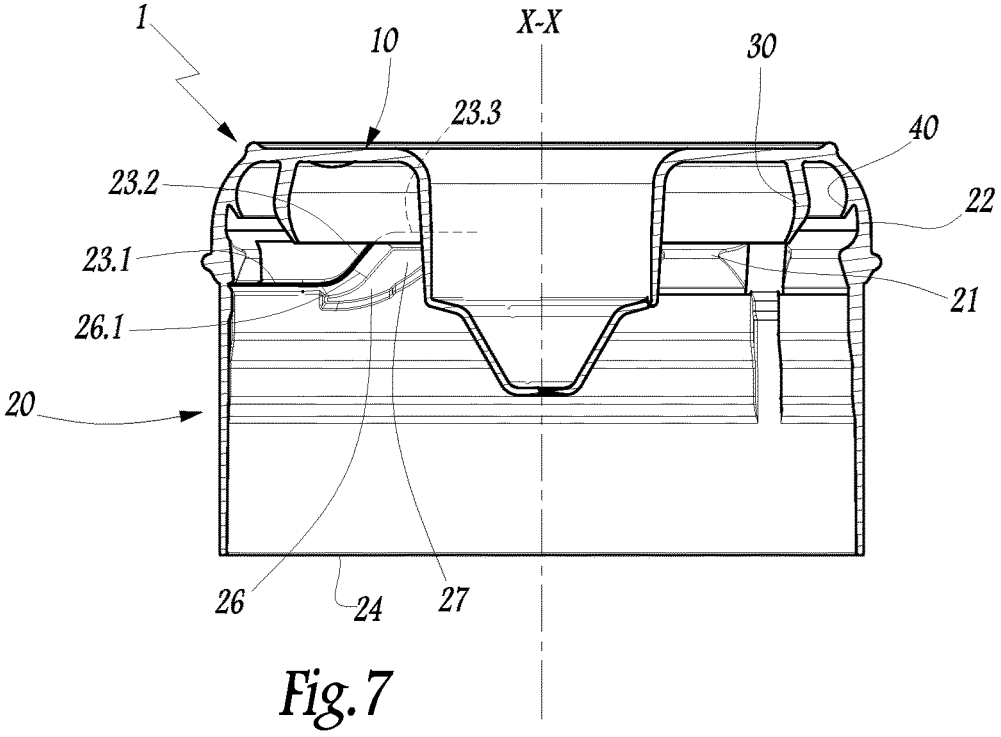

As for the part 23.2 of the weakened line 23, this connects the weakened line parts 23.1 and 23.3 to each other so that this weakened line part 23.2 extends on either side, in the direction of the axis X-X, of the reinforcing line 21, while being inclined both respectively of this bulge line 21 and with respect to the direction of the axis X-X, as clearly visible in FIGS. 3, 7 and 10.

Figure 8:
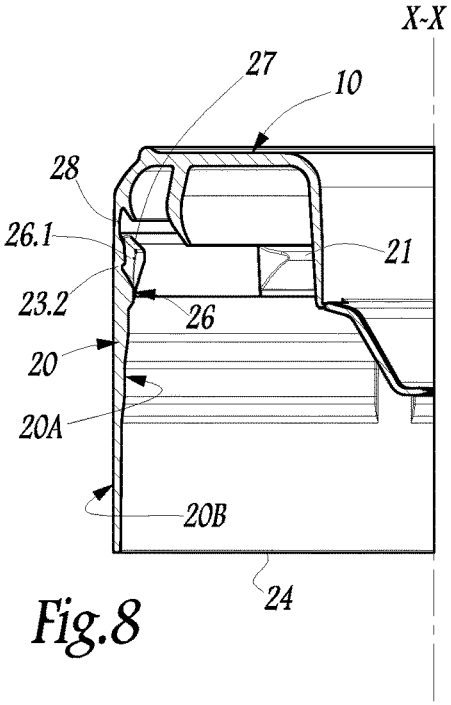
FIGS. 8 and 9 are longitudinal half-sections along respectively the radial lines VIII and IX in FIG. 5.
Figure 9:
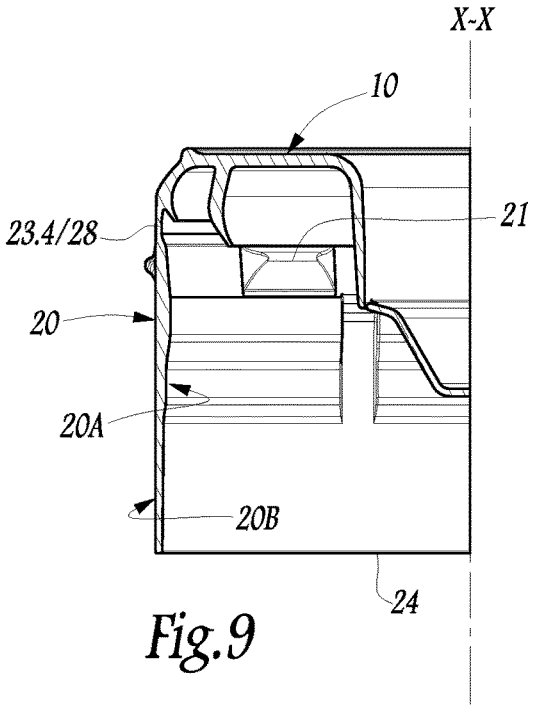

Moreover, as clearly visible in FIGS. 3, 8 and 10, the internal face 20A of the skirt 20 is provided, in the skirt portion 20.2, with a bulge 26 projecting inwards. In the peripheral end part of the skirt portion 20.2, turned towards the skirt portion 20.1, this bulge 26 is situated at the same axial level as the weakened line part 23.1: in other words, at least part of the bulge 26 is situated in the rectilinear extension of the weakened line part 23.1. In addition, when the skirt portion 20.2 is run through moving away from the skirt portion 20.1, it is noted that the bulge 26 is avoided by the weakened line part 23.2, in the sense that no part of the bulge 26 is arranged across the rectilinear direction of the weakened line part 23.2. Advantageously, the part 26.1 of the bulge 26, turned towards the weakened line part 23.2, is even conformed so that this weakened line part 23.2 runs along this part 26.1.

Also as clearly visible in FIGS. 3, 8 and 10, the internal face 20A of the skirt 20 is also provided with a bulge 27, projecting inwards and carried by the skirt portion 20.3. In the direction of the weakened line part 23.3, this bulge 27 is conformed so as to have this weakened line part 23.3 run along it on the periphery of the skirt 20, when the skirt portion 20.3 is run along from its peripheral end connected to the skirt portion 20.2.

Advantageously, in particular for reasons of moulding the cap 1, the bulges 26 and 27 are connected to each other in the connecting area between the skirt portions 20.2 and 20.3, forming in particular a relief in a single piece, projecting from the internal face 20A of the skirt 20.

In practice, it will be noted that the weakened line 23 can be produced in various ways, since these various embodiments make it possible, by rupture along this weakened line, to tear the skirt 20 along the periphery of the skirt.

Thus, by way of example that is not shown, all or part of the weakened line 23 comprises a succession of peripheral slots that locally weaken the skirt 20 and delimit between them breakable bridges obtained when the cap 1 is moulded or by cuts in the cap on emerging from the mould. This being said, in the advantageous embodiment shown in the figures, the parts 23.0, 23.1 and 23.2 of the weakened line 23 are produced by a local thinning of the wall of the skirt, recessed from the internal face 20A of the corresponding skirt portions 20.0, 20.1 and 20.2, while the part 23.3 of the weakened line consists of the portion, running over the skirt portion 20.3, of a thinned line 28 which, as clearly visible in FIGS. 8, 9 and 10, runs over the entire periphery of the skirt 20, along the top axial side of the bulge line 21, being covered externally by the band 22. It will be noted that, in FIG. 10, the thinned line 28 is shown in broken lines when it is turned towards the reader, in order to distinguish it from the weakened line 23. Thus, in the portions 20.0, 20.1 and 20.4 of the skirt 20, the thinned line 28 is covered externally and, because of this, reinforced by the band 22, while, in the skirt portions 20.2 and 20.3, the skirt 20 has an area of less strength along the thinned line 28.

As can be seen clearly in FIGS. 6 to 9, the cap 1 also comprises a sealing lip 30 that has a substantially annular shape, with a circular base and centred on the axis X-X, which extends downwards from the lid 10, being made in one piece with the bottom face of the external peripheral part 11 of this lid 10. The lip 30 runs over the entire lower periphery of the part 11 of the lid 10. This lip 30 is arranged coaxially inside the skirt 20, with the interposing radially between them of a free space which, when the cap 1 is in the closure configuration on the neck 3, is occupied by the free end 5 of the body 4 of the latter. In the embodiment considered in the figures, the lip 30 consists of a single annular wall that extends projecting downwards from the bottom face of the part 11 of the lid 10, with a thickness, or in other words a radial dimension between the internal and external faces of this wall, that decreases substantially as far as the bottom free end of this wall.

As can be seen clearly in FIG. 2, the external face of the lip 30 has, in its main part, a convex surface 31 that is intended to bear sealingly against the internal face 4A of the body 4 of the neck 3 and is connected to the bottom free end 32 of the lip 30 by a substantially flat surface 33, advantageously frustoconical, centred on the axis X-X and convergent towards this axis in the direction opposite to the lid 10.

It will be noted that this internal sealing lip 30 makes it possible to dispense with the presence of a gasket attached in the bottom of the cap 1, typically against the bottom face of the lid 10, it being noted that, generally, such a gasket has limited sealing performances and runs a risk of giving a disagreeable taste and/or odour to the liquid contained in the container 2.

Advantageously, as can be seen clearly in FIGS. 6 to 9, the cap 1 also comprises a sealing lip 40 that extends projecting inwards from the internal face 20A of the skirt 20, while being situated axially between the bulge line 21 and the top end of the skirt 20, connected to the external periphery of the lid 10. The lip 40 runs over the entire internal periphery of the skirt 20. Advantageously, the lip 40 is situated substantially radially opposite the convex surface 31 of the lip 30. In the closure configuration of the cap 1, this lip 40 bears sealingly against the heel 6. By way of variants that are not shown, this lip 40 may be replaced or supplemented by one or more external sealing elements, such as a sealing ring, etc.

When a user wishes to manually release the cap 1 vis-à-vis the neck 3 of the container 2, he grips the tongue 25 and then pulls on it so as to move it away transversely from the neck 3. This local deformation of the skirt 20.0 initiates a tear along the part 23.0 of the weakened line 23. Then, by continuing to pull the tongue 25 and, more generally, the strip that forms the part of the skirt 20 situated below the weakened line 23, the tearing of the skirt 20, by rupture of the weakened line 23, propagates along first the part 23.0 of this weakened line and then the part 23.1 thereof. The curved profile of the connecting area between the weakened line parts 23.0 and 23.1 facilitates the propagation of the tear, progressively guiding the change in direction of the tear. Thus it will be understood that the tearing of the skirt 20 propagates along the bottom side of the bulge line 21, in a rectilinear fashion as far as the bulge 26, which then prevents the tear propagating from the skirt portion 20.1 to the skirt portion 20.2 in the rectilinear extension of the weakened line part 23.1. At the same time, the part 26.1 of the bulge 26 forms a guide ramp for the tearing so that the latter propagates along the weakened line part 23.2, being guided by this ramp 26.1. In doing this, the tear passes progressively from the bottom axial side to the top axial side of the bulge line 21. It will be understood that the change in direction of the tear along the weakened line part 23.2 is controlled by the inclination of the latter, and hence the advantage that this inclination is not too vertical, failing which the tear risks propagating outside the planned path if the user exerts an excessively abrupt tangential and horizontal pull; naturally, the aforementioned inclination may also not be too horizontal, in the sense that the tear must, in the end, pass the bulge line 21 on the skirt portion 20.2, the extent of which is not unlimited; thus, according to a preferential embodiment, the inclination between the weakened line part 23.2 and the direction of the axis X-X is between 30° and 60°, or even equal to approximately 45°, in particular to within plus or minus 5°. Then the tear propagates along the weakened line part 23.3, being guided by the bulge 27. As before, it will be understood that the curved profile of the connecting area between the weakened line parts 23.1 and 23.2 and the connecting area between weakened line parts 23.2 and 23.3 facilitates the progressive propagation of the tear between the weakened line parts concerned.

When the tear is thus propagated as far as the end of the part of the weakened line 23.3 opposite to the part 23.2, two cases can be envisaged with regard to the remainder of the action on the cap 1 by the user. It should also be noted that the user is potentially warned of the fact that he has completely ruptured the weakened line 23 by the fact that, in order to propagate further the tearing of the skirt 20, in rectilinear extension of the weakened line part 23.3, the user must overcome the resistance to rupture of the band 22, over all or part of the skirt portion 20.4.

According to a first case, the user ceases to pull horizontally on the strip formed by the bottom part of the skirt 20, which is connected to the rest of the cap 1, remaining in place around the neck 3, only by the skirt portion 20.4: the user can then grip this strip by hand and use it to drag the entire cap 1 upwards in order to release it from the neck 3.

This being the case, in practice, it is found that this first case is not the one that is the most frequent, in that, naturally, the user rather has a tendency to seek to force the propagation of the tearing on the skirt portion 20.4, in rectilinear extension of the weakened line part 23.3.

Thus, according to a second case that is in principle more frequent, the user propagates the tearing over the entire skirt portion 20.4, overcoming the resistance to tearing of the hand 22 along the thinned line 28. In the end, the user then completely detaches the aforementioned strip, as well as most of the rest of the skirt 20, vis-à-vis the lid 10 and the remainder of the skirt 20, not connected to the major part of the skirt thus torn away. It should be noted that the aforementioned skirt remainder does not include, on its periphery, the whole of the bulge line 21: on the contrary, the entire portion of this bulge line 21, running over the skirt portions 20.3 and 20.4, is carried by the aforementioned torn-away part of the skirt 20. This is easily understood by remarking that the aforementioned torn-away part of the skirt 20 corresponds both to the entire part of the skirt situated below the weakened line 23 and, in the skirt portion 20.4, to the skirt part situated below the thinned line 28, as clearly visible in FIG. 10. Consequently, a substantial portion of the bulge line 21 no longer acts vis-à-vis the neck 3 in order to retain the part of the cap 1 still in place on this neck. The user can therefore very easily extract this remaining part of the cap, in the remaining part of the bulge line 21 no longer opposing any significant resistance to this extraction. As for any resistance to extraction related to the sealed bearing of the lip 30 against the internal face 4A of the neck 4 of the neck 3, it can then easily be overcome by the user, in particular at the skirt portion 20.4.

It will be understood that the above considerations apply partly to the first case mentioned above, since the portion of the bulge line 21, running over the skirt portion 20.3, no longer participates with the rest of this bulge line in holding the cap 1 around the neck: the upward extraction of the whole of the cap is therefore facilitated thereby.

Various arrangements and variants to the cap 1 described up until now can moreover be envisaged:

- one or other or both of the bulges 26 and 27 may have, in particular on their side turned towards the weakened line 23, bevelled surfaces which, among other things, assist the propagation of the tear along this weakened line, preventing or at the very least limiting the fact that these bulges 26 and 27 interfere locally with the deformations, in particular in twisting, of the wall of the skirt during manual actions by the user to pull away this skirt, as described above; the aforementioned bevels also have an advantage related to the removal of the skirt 20 from the mould in that their slopes facilitate this removal from the mould inside the skirt;
- one or other or both of the bulges 26 and 27 may be conformed so as to participate, in addition to the action of the bulge line 21, in fixing the skirt 20 about the neck 3, cooperating by wedging with the heel 6 of this neck; in other words, in the skirt portions 20.2 and 20.3 the bulges 26 and 27 then advantageously form part of means of holding the cap on the neck, which include the bulge line 21; and/or by virtue of the invention, it will be noted that the respective angular sizings of the successive portions 20.0 to 20.4 of the skirt 20 are not limited to those shown in the figures; in particular, according to a variant that is not shown, it can entirely be envisaged that all the skirt portions 20.0 to 20.3 extend over less than 180° around the axis X-X, without affecting the performances of the invention.

The invention claimed is:

1. A cap for closing a neck of a container, comprising:

a lid arranged across an opening of the neck when the cap is in a closed configuration, wherein the lid is configured to close off the neck;

a skirt configured to be fixed to the neck, wherein:

the skirt is substantially tubular and centered on an axis, the skirt extends axially from the lid and is arranged around the neck of the container when the cap is in the closed configuration, and the skirt includes:

a peripheral bulge line that projects from an internal face of the skirt and is configured to interfere, by wedging, with an external projecting heel of the neck so as to fix the skirt around the neck, a peripheral weakened line configured to be broken by propagation of a tearing of the skirt along the weakened line when the cap is released with respect to the neck, the weakened line including:

a first part that is substantially rectilinear along a first portion of the skirt, the first part extending along the bulge line on an axial side of the bulge line opposite to the lid, a second part that is substantially rectilinear along a second portion of the skirt and continues from the first part, and a third part that is substantially rectilinear along a third portion of the skirt and continues from the second part, a stop means comprising a bulge having a tip that extends below to the peripheral weakened line at the first part, the tip configured to redirect tearing along the weakened line, wherein:

the second part of the weakened line is configured to redirect the tear around the tip, and extend on either side of the bulge line, the second part of the weakened line being inclined with respect to the bulge line and the direction of the axis, and the third part configured to extend along the bulge line on the axial side of the bulge line closer to the lid, and a fourth portion of the skirt adjacent to the third portion of the skirt, wherein:

the third part of the weakened line is configured to end before the fourth portion of the skirt such that the tearing of the skirt along the weakened line is propagated as far as the end of the third part of the weakened line.

2. The cap according to claim 1, wherein the lid further includes an internal sealing lip that is configured to seal against the internal face of the neck when the cap is in the closed configuration.

3. The cap according to claim 1, wherein the lid further includes at least one external sealing element that is configured to seal against the external face of the neck when the cap is in the closed configuration.

4. The cap according to claim 1, wherein the cap is without a gasket.

5. The cap according to claim 1, wherein a first area connecting the first part to the second part of the weakened line and a second area connecting the second part to the third part of the weakened line are curved.

6. The cap according to claim 1, wherein the second part of the weakened line is inclined at an angle between 30° and 60° from the direction of the axis.

7. The cap according to claim 1, wherein:

the stop means comprises a guidance ramp configured to guide tearing, the guidance ramp is arranged across the rectilinear extension of the first part of the weakened line, and the second part of the weakened line is positioned along the guidance ramp on a periphery of the second portion of the skirt.

8. The cap according to claim 7, wherein the guidance ramp projects onto the internal face of the skirt.

9. The cap according to claim 1, wherein:

the third portion of the skirt further includes a guidance element for guiding tearing, and the third part of the weakened line is arranged along the guidance element on a periphery of the third portion of the skirt.

10. The cap according to claim 9, wherein in a connecting area between the second and third portions of the skirt, the guidance ramp and the guidance element are connected to each other.

11. The cap according to claim 10, wherein the guidance ramp and the guidance element are made in one piece with each other.

12. The cap according to claim 9, wherein the guidance element projects onto the internal face of the skirt.

13. The cap according to claim 1, wherein:

the skirt further includes a peripheral band projecting from the external face of the skirt and situated substantially at the same axial level as the bulge line, and on the periphery of the skirt, the peripheral band is interrupted continuously over substantially all of the second and third portions of the skirt.

14. The cap according to claim 13, wherein:

the first and second parts of the weakened line are produced by a local thinning of a wall of the skirt that is recessed from the internal face of the skirt, the skirt further includes a thinned line that runs over the entire periphery of the skirt along the bulge line while being situated on the axial side of the bulge line closer to the lid, and the thinned line is covered externally by the peripheral band so that, in the third portion of the skirt, the thinned line constitutes the third part of the weakened line.

* * * * *